US006354281B1

(12) United States Patent
Mitsutani

(10) Patent No.: US 6,354,281 B1
(45) Date of Patent: Mar. 12, 2002

(54) EVAPORATIVE FUEL CONTROL APPARATUS AND METHOD

(75) Inventor: Noritake Mitsutani, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/712,954

(22) Filed: Nov. 16, 2000

(30) Foreign Application Priority Data

Dec. 24, 1999 (JP) ..... 11-368007

(51) Int. Cl.[7] ..... F02M 37/04
(52) U.S. Cl. ..... 123/520
(58) Field of Search ..... 123/516, 518, 123/519, 520

(56) References Cited

U.S. PATENT DOCUMENTS 5,460,143 A * 10/1995 Narita ..... 123/520
5,497,757 A 3/1996 Osanai
5,778,859 A 7/1998 Takagi
5,893,353 A * 4/1999 Mukai ..... 123/520
6,325,052 B1 * 12/2001 Mashiki ..... 123/520

* cited by examiner

*Primary Examiner*—Thomas N. Moulis
(74) *Attorney, Agent, or Firm*—Oliff & Berridge PLC

(57) ABSTRACT

A controller controls a purge amount adjusting valve provided in a purge passage, thereby purging an amount of vapor in accordance with an operating state from a canister into an intake passage. The controller detects an internal pressure of a fuel tank with a pressure sensor provided therein, and determines the fact that a tank internal pressure control valve provided in a vapor passage is open based on the detection result. When the controller determines that the tank internal pressure control valve is open, the controller can, e.g., fully close the purge amount adjusting valve and then gradually open the opening amount of the purge amount adjusting valve such that an amount of vapor in accordance with the operating state is purged.

10 Claims, 4 Drawing Sheets

TANK INTERNAL PRESSURE CONTROL VALVE
OPEN
CLOSED

ON
VALVE OPEN FLAG
OFF
GREATER

OPENING OF PURGE AMOUNT ADJUSTING VALVE
FULLY CLOSED
GREATER

PURGE AMOUNT
t 0
TIME

EVAPORATIVE FUEL CONTROL APPARATUS AND METHOD

INCORPORATION BY REFERENCE

The disclosure of Japanese Patent Application No. 11-368007, filed on Dec. 24, 1999 including, the specification, drawings and abstract is incorporated herein by reference in its entirety.

BACKGROUND OF THE INVENTION

1. Field of Invention

The invention relates to an evaporative fuel control apparatus and a control method therefor for an internal combustion engine for purging evaporated fuel in a fuel tank into an intake passage of the internal combustion engine.

2. Description of Related Art

There is a conventional evaporative fuel control apparatus for collecting evaporated fuel (vapor) generated in a fuel tank in a canister and purging the collected vapor into an intake passage of an internal combustion engine from the canister as required.

In the conventional evaporative fuel control apparatus, in order to suppress an adverse effect on an air-fuel ratio of the internal combustion engine, the purge passage is provided with a purge-amount adjusting valve, such that the purge amount is controlled in accordance with an operation state of the engine by opening and closing the purge-amount adjusting valve.

In general, purge air that is purged into the intake passage from the canister includes not only purge air that has been once adsorbed by adsorbent of the canister and then separated from the adsorbent (separated vapor, hereinafter), but also purge air where the fuel component has not been sufficiently adsorbed by the adsorbent and is purged into the intake passage from the fuel tank through the canister (tank vapor, hereinafter). Therefore, when the purge is controlled while taking only the separated vapor into consideration, this purge may disturb the air-fuel ratio due to the tank vapor or may adversely affect the emission due to disturbance of the air-fuel ratio.

To avoid the above inconvenience, there is another conventional apparatus such as that disclosed in Japanese Patent Application Laid-open No. 9-303219 which has an evaporative fuel control apparatus for controlling the purge while taking both the separated vapor and tank vapor into consideration.

According to the other conventional apparatus, a purge ratio based on the separated vapor amount and a purge ratio based on the tank vapor amount are calculated as upper limit values of the purge ratio (purge amount/intake air amount), and the smallest of the upper limit values of the purge ratio is set as a maximum purge ratio so as to limit the upper limit of the purge amount.

Further, according to the other conventional evaporative fuel control apparatus, a tank internal pressure control valve which is opened when the pressure in the fuel tank exceeds a predetermined pressure is provided midway in a passage (vapor passage) for bringing the fuel tank and the canister into communication with each other. By providing such a valve, it is possible to prevent the vapor from being excessively introduced into the canister from the fuel tank, such that a predetermined adsorbing ability in the canister can be maintained.

However, if the tank internal pressure control valve is opened during execution of the purging operation and a large amount of vapor is introduced into the canister from the fuel tank through the vapor passage, problems such as those below which cannot be ignored arise.

That is, if a large amount of vapor is introduced into the canister from the fuel tank, the amount of the introduced vapor will exceed the adsorbing limit and this vapor exceeding the adsorbing limit will be passed into the intake passage without adsorption or purge added. This may then disturb the air-fuel ratio or may adversely affect the emission due to a disturbance of the air-fuel ratio.

Thus, in all of the conventional apparatus, the vapor amount is limited based on the tank vapor, and an excessive increase in tank vapor, that may be caused by opening the tank internal pressure control valve, is not taken into consideration, and it is not possible to cope with a deterioration in the air-fuel ratio control caused by the disturbance of the air-fuel ratio.

SUMMARY OF THE INVENTION

It is one object of the invention to provide an evaporative fuel control apparatus for an internal combustion engine capable of suppressing deterioration in the air-fuel ratio control which may be caused by vapor in the fuel tank being introduced into the canister during execution of the purging operation.

According to a first aspect of the invention, there is provided an evaporative fuel control apparatus for an internal combustion engine having a canister for collecting evaporated fuel generated in a fuel tank, an introducing valve in a communication passage between the canister and the fuel tank, which introduces the evaporated fuel in the fuel tank into the canister, a purge amount adjusting valve in a purge passage between the canister and an intake passage of the internal combustion engine, which adjusts an amount of purge to be purged from the canister to the intake passage and a controller that controls the purge amount adjusting valve based on an operating state of the engine. The controller decreases the opening amount of the purge amount adjusting valve to less than a target opening amount, based on the operating state of the engine, when the introducing valve is opened.

With the above arrangement, when the introducing valve is opened, the opening amount of the purge amount adjusting valve is decreased so that the purge amount is controlled to be smaller than an amount corresponding to the target purge ratio. Therefore, even if vapor in the fuel tank is introduced to the canister as the introducing valve is opened such that the vapor amount and concentration of the vapor in the canister are temporarily increased, it is possible to suppress a deterioration in air-fuel ratio control.

In the above aspect, it is possible that when the controller decreases the opening amount of the purge amount adjusting valve to less than the target opening amount, the controller fully closes the purge amount adjusting valve.

With this arrangement, it is possible to more reliably suppress the deterioration in the air-fuel ratio control.

In the above aspect, it is possible that the controller decreases the opening amount of the purge amount adjusting valve to less than the target opening and then gradually increases the opening amount up to the target opening amount.

With this arrangement, the opening amount of the purge amount adjusting valve is decreased to less than the target opening amount and then the opening amount is gradually increased up to the target opening amount based on the operating state of the engine. Therefore, it is possible to suppress abrupt variation in vapor amount and concentration of vapor to be purged by the intake passage, to suppress the deterioration in the air-fuel ratio control, and to ensure a predetermined purge amount corresponding to the target purge amount.

In the above aspect, the apparatus may further include a pressure sensor for detecting an internal pressure of the fuel tank. The controller may judge a valve-opening timing of the introducing valve based on the internal pressure of the fuel tank detected by this pressure sensor, and decrease the opening amount of the purge amount adjusting valve to less than the target opening amount based on the judged valve-opening timing.

With this arrangement, even if the introducing valve is a valve which cannot directly detect the opening or closing state thereof such as a differential pressure regulating valve which is opened and closed in accordance with a differential pressure between the internal pressure of the fuel tank and a predetermined reference pressure, it is possible to easily and reliably judge the valve-opening timing of the introducing valve, to precisely grasp the timing for introducing the vapor into the canister from the fuel tank, and appropriately suppress deterioration in the air-fuel ratio control.

BRIEF DESCRIPTION OF THE DRAWINGS

The foregoing and other objects, features and advantages of the invention will become apparent from the following description of preferred embodiments with reference to the accompanying drawings in which like reference numerals designate like elements and wherein.

DETAILED DESCRIPTION OF PREFERRED EMBODIMENTS

An embodiment of an evaporative fuel control apparatus for an internal combustion engine of the invention will hereinafter be described with reference to the drawings.

Figure 1:
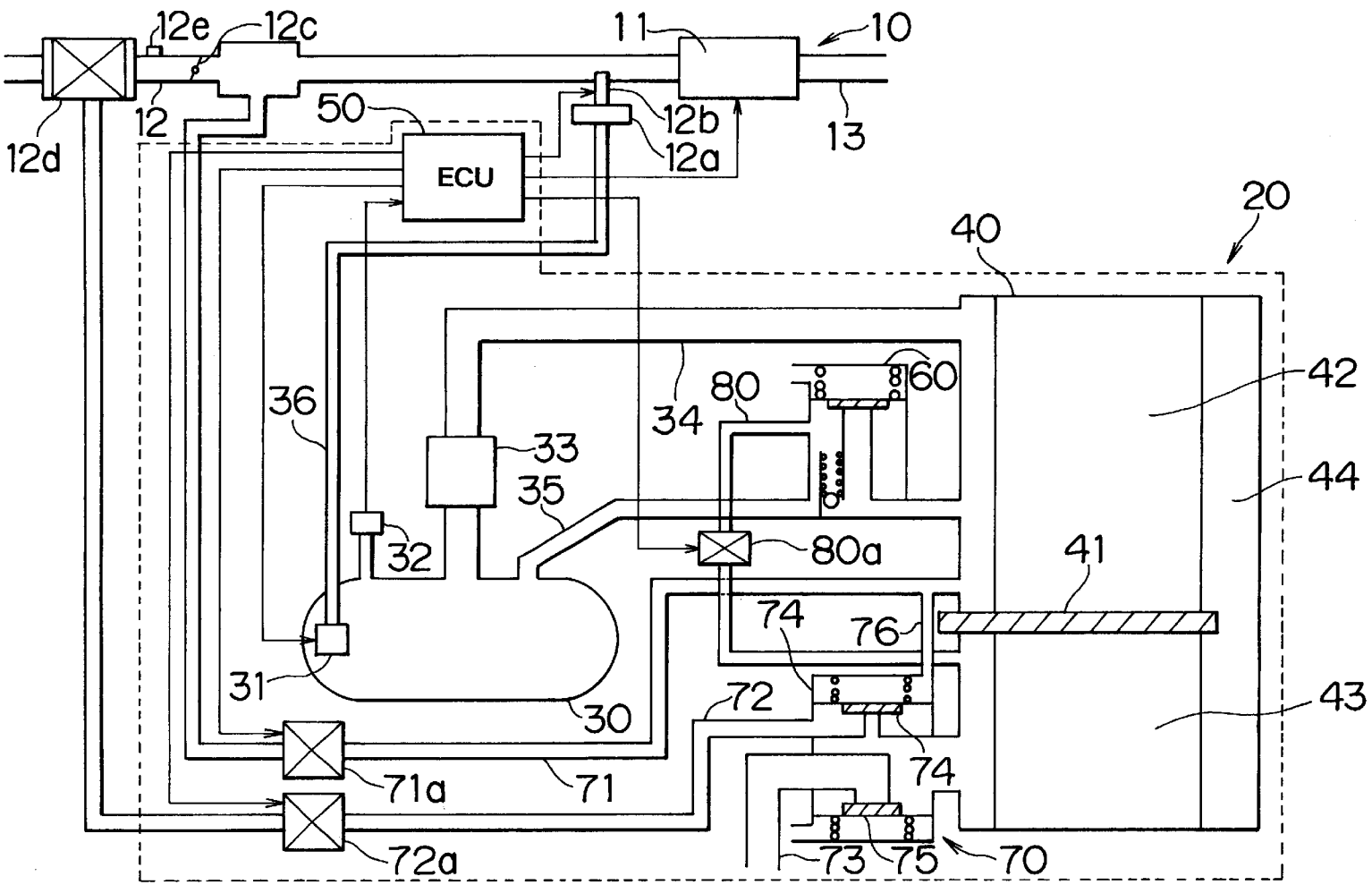
FIG. 1 is a schematic diagram showing a structure of an evaporative fuel control apparatus for an internal combustion engine according to an embodiment of the invention.

FIG. 1 is a schematic diagram showing the structure of an engine 10 and an evaporative fuel control apparatus 20 thereof in the embodiment. As shown in FIG. 1, the engine 10 is mounted in a vehicle, and includes a combustion chamber 11, an intake passage 12, an exhaust passage 13 and the like. The intake passage 12 is provided at an upstream portion thereof with a throttle valve 12*c* for adjusting the intake air amount. The intake passage 12 is also provided at an even further upstream portion thereof with an air cleaner 12*d* and an air flow meter 12*e* for detecting the intake air amount.

For operating the engine 10, fuel in a fuel tank 30 is pumped up by a fuel pump 31 and sent to a delivery pipe 12*a* through a fuel supply passage 36. The fuel is supplied to a fuel injection valve 12*b* from the delivery pipe 12*a* and then injected and supplied into the intake passage 12 from the delivery pipe 12*a*.

Meanwhile, the evaporative fuel control apparatus 20 generally includes a canister 40 for collecting vapor generated in the fuel tank 30, and a purge passage 71 for purging the collected vapor into the intake passage 12, and the like.

Formed in the canister 40 are a main chamber 42 and an auxiliary chamber 43 partitioned by a partition plate 41, and a diffusion chamber 44 for bringing the main chamber 42 and the auxiliary chamber 43 into communication with each other. Adsorbent (e.g., activated carbon) for adsorbing the vapor is filled into the main chamber 42 and the auxiliary chamber 43.

The purge passage 71 connected to the intake passage 12 is connected to the canister 40 at a portion on the main chamber 42 side. The purge passage 71 is provided with a purge amount adjusting valve 71*a* for adjusting an amount of vapor to be purged from the canister 40 into the intake passage 12, i.e., an amount of purge by adjusting the cross sectional area of the purge passage 71. The opening of the purge amount adjusting valve 71*a* is controlled in accordance with a target purge ratio that is set based on the operating state of the engine.

A tank internal pressure control valve 60 is mounted to the canister 40 at a portion on the main chamber 42 side. The tank internal pressure control valve 60 is connected to the fuel tank 30 through a vapor passage 35. The tank internal pressure control valve 60 is a diaphragm-type differential pressure regulating valve which opens when an internal pressure of the fuel tank 30 exceeds an internal pressure of the canister 40 by a predetermined value. If the tank internal pressure control valve 60 is open, the vapor in the fuel tank 30 is introduced into the main chamber 42 of the canister 40 through the vapor passage 35.

A breather valve 33 such as a diaphragm-type differential pressure regulating valve like the tank internal pressure control valve 60 is mounted to the fuel tank 30. The breather valve 33 is connected to the main chamber 42 of the canister 40 through a breather passage 34. When the vapor is supplied to the fuel tank 30, if the internal pressure of the fuel tank 30 exceeds a predetermined pressure, the breather valve 33 opens. When the breather valve 33 is open, the vapor in the fuel tank 30 is introduced into the canister 40 through the breather passage 34.

An atmospheric valve 70 is mounted to the canister 40 at a portion on the auxiliary chamber 43 side. Connected to this atmospheric valve 70 are an atmosphere introducing passage 72 connected to the air cleaner 12*d* of the intake passage 12, an atmosphere discharge passage 73, one end of which is open into atmosphere, and a branch passage 76 connected to the purge passage 71.

The atmosphere introducing passage 72 is provided with an atmosphere introducing valve 72*a* for opening and closing the atmosphere introducing passage 72. The atmosphere introducing valve 72*a* is usually open, and is closed only when an abnormal condition of the evaporative fuel control apparatus is diagnosed. The description of the diagnosis of abnormal conditions is omitted.

The atmospheric valve 70 includes two diaphragm valves 74 and 75 having different functions. The first diaphragm valve 74 is opened when the pressure in the purge passage 71 is decreased to a predetermined pressure when the purging operation is carried out. If the first diaphragm valve 74 is opened, atmospheric air is introduced into the auxiliary chamber 43 through the atmosphere introducing passage 72.

Meanwhile, the second diaphragm valve 75 is opened if the internal pressure of the auxiliary chamber 43 exceeds a predetermined pressure that is higher than the atmospheric pressure, for example, when the breather valve 33 is opened and a large amount of vapor is introduced into the canister 40. If the second diaphragm valve 75 is opened, vapor (air) whose fuel component is removed by the adsorbent in the canister 40 is discharged into the atmosphere from the auxiliary chamber 43 through the atmosphere discharge passage 73.

The tank internal pressure control valve 60 is connected to a bypass passage 80, and the bypass passage 80 is connected to the auxiliary chamber 43. The auxiliary chamber 43 is brought into communication with the fuel tank 30 through the bypass passage 80, an interior of the tank internal pressure control valve 60 and the vapor passage 35. The bypass passage 80 is provided with a bypass valve 80*a*. The bypass valve 80*a* is usually open, and closed only when an abnormal condition is diagnosed.

In the evaporative fuel control apparatus, a pressure sensor 32 for detecting an internal pressure of the fuel tank 30 is mounted to the fuel tank 30. The pressure sensor 32 is connected to an electrical control unit (ECU) 50, and a detection signal of the pressure sensor 32 is output to the ECU 50.

The ECU 50 carries out the purging operation by controlling the opening and closing action of the valves 71*a*, 72*a*, and 80*a*, and also carries out abnormal condition diagnosis, control of the air-fuel ratio, and various other control measurements. The ECU 50 includes a processor, an input circuit into which a detection signal of the pressure sensor 32 is input, an output circuit (not shown) for outputting driving signals to the valves 71*a*, 72*a*, and 80*a*, and a memory in which various control programs and their function data are stored.

In an evaporative fuel control apparatus having such a structure, if vapor is generated and the internal pressure of the fuel tank 30 and the tank internal pressure control valve 60 is opened, the vapor in the fuel tank 30 is introduced into the canister 40 through the vapor passage 35. When the vapor is supplied and the breather valve 33 is opened, the vapor in the fuel tank 30 is introduced into the canister 40 not only through the vapor passage 35 but also through the breather passage 34. In this way, the vapor introduced into the canister 40 is once adsorbed by the adsorbent in the main chamber 42 or the auxiliary chamber 43.

Meanwhile, if the purge amount adjusting valve 71*a* is opened during operation of the engine 10, pressure in the intake passage 12 is introduced into the purge passage 71. As this pressure is introduced, the first diaphragm valve 74 is opened, and atmosphere is introduced into the canister 40 through the atmosphere introducing passage 72. The fuel component adsorbed by the adsorbent in the chambers 42 or 43 is separated from the adsorbent and becomes vapor again, and is introduced into the intake passage 12 through the purge passage 71. The vapor introduced into the intake passage 12 is then burned in the combustion chamber 11 together with the fuel injected from the fuel injection valve 12*b*.

Here, according to the evaporative fuel control apparatus of the embodiment, when the tank internal pressure control valve 60 is opened during execution of the purging operation, this opening of the valve 60 is detected, and the purge amount is limited such that this amount temporarily becomes smaller than an amount corresponding to the target purge ratio. More specifically, when it is detected that the tank internal pressure control valve 60 was opened, the purge amount adjusting valve 71*a* is once fully closed and then, the purge amount adjusting valve 71*a* is gradually opened until the opening of the valve 71*a* becomes equal to an opening corresponding to the target purge ratio. A control mode of the purge amount adjusting valve 71*a* when the tank internal pressure control valve 60 was opened during execution of the purging operation will hereinafter be described with reference to FIGS. 2 to 4.

A control procedure for judging the open and closed state of the tank internal pressure control valve 60 will first be described with reference to a flowchart shown in FIG. 2. This series of control measures is executed by the ECU 50 which causes an interrupt at predetermined crank angles.

In this control method, the ECU 50 judges, in step S110, whether an internal pressure Pt in the fuel tank 30 detected based on an output signal of the pressure sensor 32 is equal to or greater than a predetermined value PA. Here, the predetermined valve-opening pressure PA is a value that was previously determined by experiment as an internal pressure of the fuel tank 30 when the tank internal pressure control valve 60 is reliably opened. That is, when the internal pressure Pt is equal to or greater than the predetermined value PA, it is possible to judge that the tank internal pressure control valve 60 is open.

If the ECU 50 judges that the internal pressure Pt is equal to or greater than the predetermined value PA, the flow proceeds to step S 120 where an open valve flag XTNKOPN indicating that the tank internal pressure control valve 60 is currently open is set to ON. As will be described later, in this embodiment, the purge amount adjusting valve 71*a* is fully closed immediately after the tank internal pressure control valve 60 was opened. Therefore, the internal pressure Pt of the fuel tank 30 becomes equal to or greater than the predetermined value PA during a predetermined period immediately after the tank internal pressure control valve 60 was opened.

On the other hand, if the ECU 50 judges that the internal pressure Pt is less than the predetermined value PA, it is judged whether the open valve flag XTNKOPN is ON in step S130. If the ECU 50 judges that the open valve flag XTNKOPN is currently ON, the flow proceeds to step S140. If it is judged that the open valve flag XTNKOPN is not ON, i.e., if is judged that the open valve flag XTNKOPN is currently OFF, this routine is once completed.

In step S140, the ECU 50 judges whether the purge amount is equal to or smaller than a predetermined amount $\alpha$ or whether the tank internal pressure Pt is equal to or greater than a predetermined closing-valve pressure PB. Here, the predetermined amount $\alpha$ is a value that was determined by experiment as a purge amount when the tank internal pressure control valve 60 is reliably closed. If the purge amount is small, a difference between the pressure in the canister 40 and the tank internal pressure Pt disappears and thus, the tank internal pressure control valve 60 closes. The predetermined closing-valve pressure PB is a value that was previously determined by experiment like the predetermined value PA as an internal pressure of the fuel tank 30 when the tank internal pressure control valve 60 is reliably closed. The predetermined closing-valve pressure PB is determined as a value smaller than the predetermined value PA. This is because after the tank internal pressure control valve 60 is opened, this valve 60 remains open by a fluid pressure of the vapor moving in the vapor passage 35 even if the tank internal pressure Pt becomes equal to or less than the predetermined value PA.

If the ECU 50 judges that the purge amount is equal to or smaller than the predetermined amount a or that the tank internal pressure Pt is equal to or smaller than the predetermined closing-valve pressure PB, the flow proceeds to step S150 where the ECU 50 judges that the tank internal pressure control valve 60 is closed, and the open valve flag XTNKOPN is set to OFF. Then, this routine is once completed.

On the other hand, if the ECU 50 judges in step S140 that the purge amount is greater than the predetermined amount a and the tank internal pressure Pt is greater than the predetermined closing-valve pressure PB, it is judged that the tank internal pressure control valve 60 is open, and this routine is once completed without changing the open valve flag XTNKOPN.

As described above, in this embodiment, even if the tank internal pressure control valve 60 is a valve which cannot directly detect the open or closed state thereof, it is possible to easily and reliably judge the opening timing of the valve.

Figure 3:
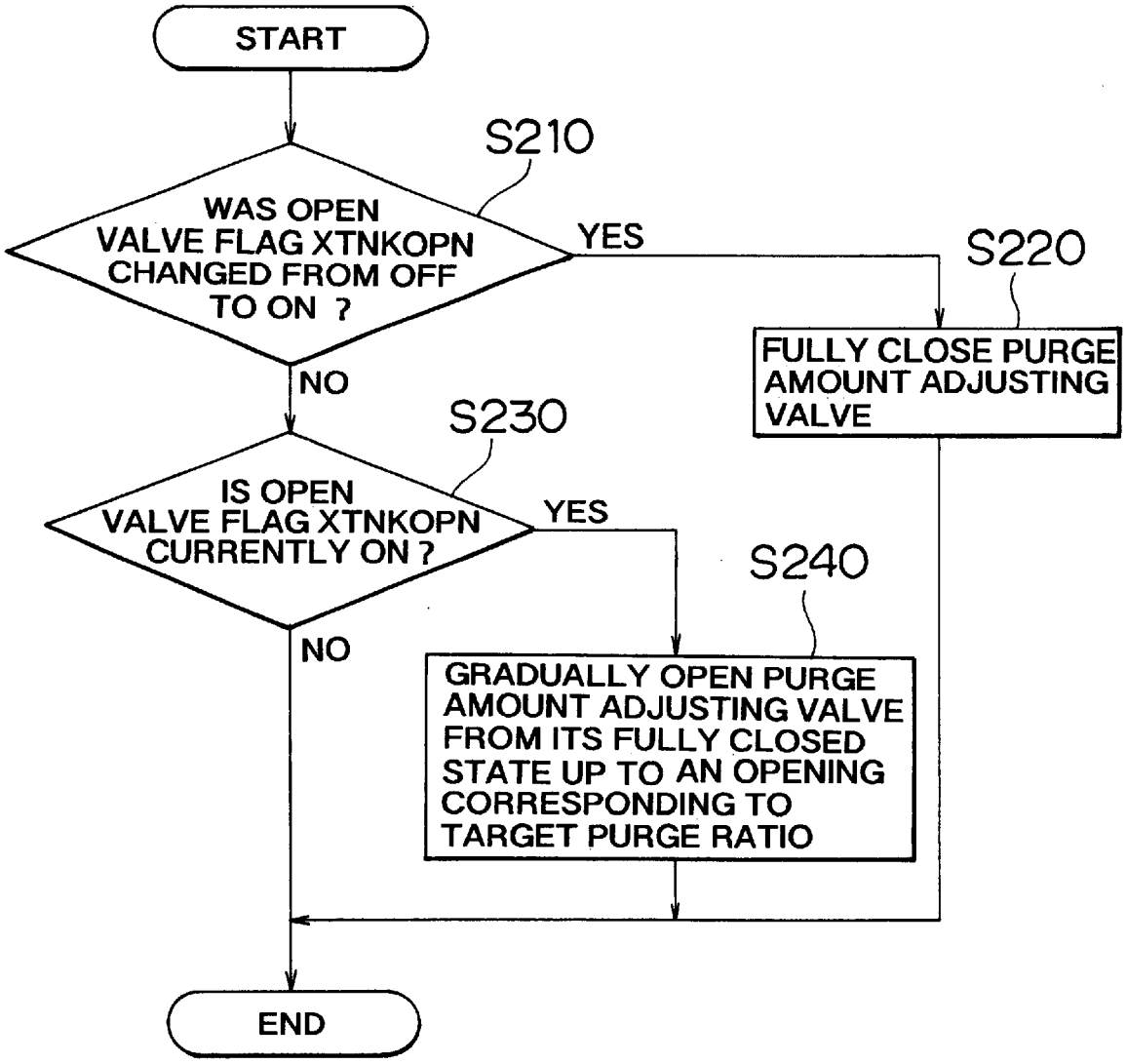
FIG. 3 is a flowchart showing a control procedure when the opening of a purge amount adjusting valve is controlled in the embodiment.

Next, the control procedure when the opening operation of the purge amount adjusting valve 71a is controlled based on the open valve flag XTNKOPN will be described with reference to the flowchart shown in FIG. 3. FIG. 4 shows the change in the opening of the purge amount adjusting valve over time. This control is also executed by the ECU 50 by causing an interrupt at every predetermined crank angle.

In step S210, the ECU 50 judges whether the open valve flag XTNKOPN has changed from OFF to ON. There, if the ECU 50 judged that the open valve flag XTNKOPN changed from OFF to ON, i.e., the tank internal pressure control valve 60 that was closed in the last control cycle was open until the current control cycle (time to in FIG. 4), the flow proceeds to step S220 where the purge amount adjusting valve 71*a* is once closed even if the purge amount adjusting valve 71*a* is opened with a predetermined opening during execution of the purging operation (see FIGS. 4A, 4B, and 4C). Therefore, the opening of the purge amount adjusting valve 71*a* is set less than the opening that is set based on the target purge ratio. As a result, even if the tank internal pressure control valve 60 is opened and a large amount of vapor flows into the canister 40 from the fuel tank 30, the vapor is not introduced into the intake passage 12, and the disturbance of the air-fuel ratio is appropriately suppressed.

On the other hand, if the ECU 50 judges in step S210 that the open valve flag XTNKOPN has not changed from OFF to ON, the flow proceeds to step S230. In step S230, the ECU 50 judges whether the open valve flag XTNKOPN is set to ON. Here, if the ECU 50 judges that the open valve flag XTNKOPN is set to ON, i.e., the tank internal pressure control valve 60 is open, the flow proceeds to step S240 where the opening of the purge amount adjusting valve 71*a* is gradually increased with a predetermined speed to an opening set based on the target purge ratio as shown in FIG. 4C.

Figures 4A, 4B, 4C, 4D:
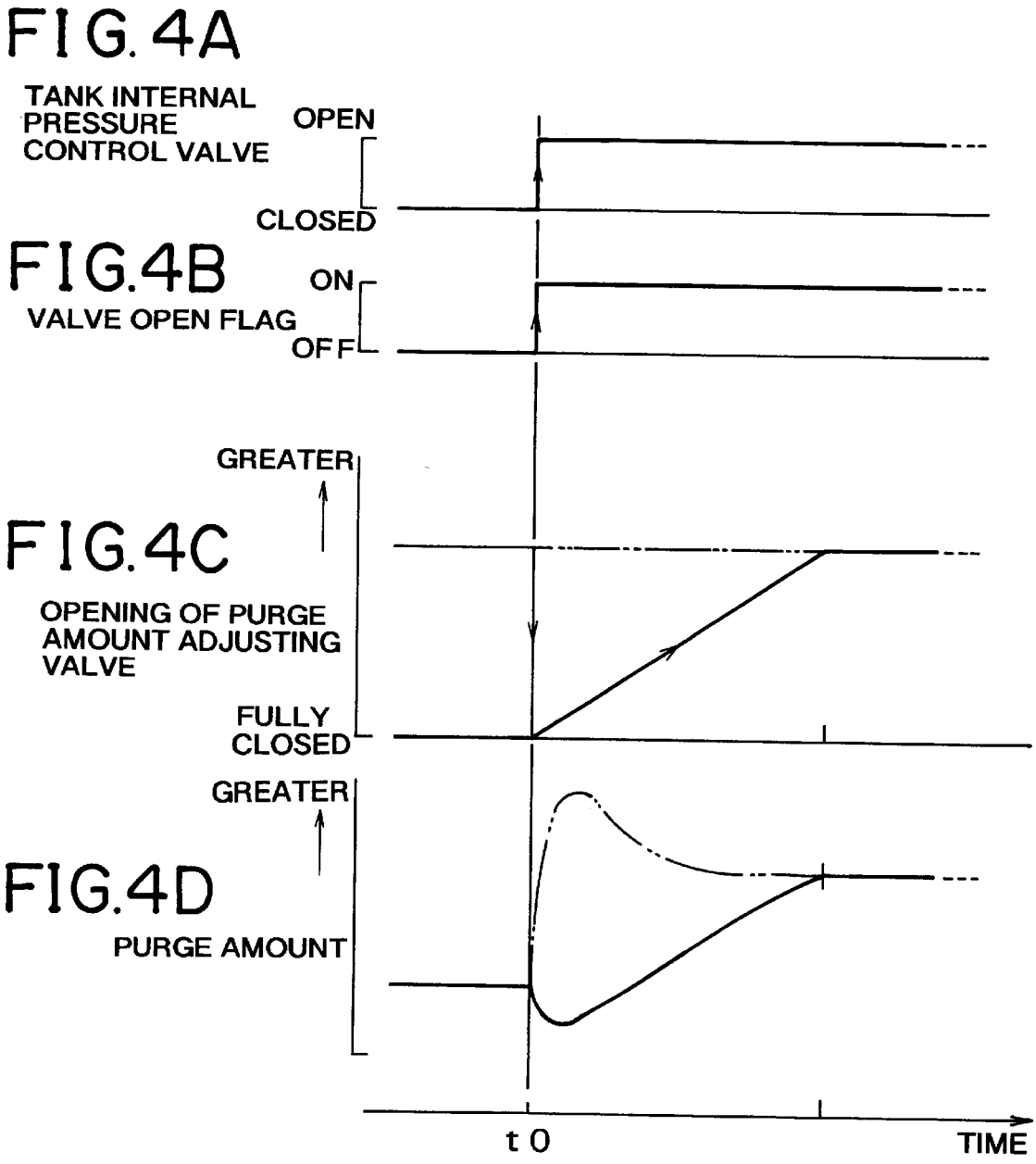
FIGS. 4A to 4D are timing charts showing the opening control of the purge amount adjusting valve when the tank internal pressure control valve is opened in the embodiment.

Therefore, as shown in FIG. 4D, the purge amount is gradually increased up to an amount corresponding to the target purge ratio. For this reason, when the predetermined opening of the purge amount adjusting valve 71*a* is maintained when the tank internal pressure control valve 60 is open (shown with the alternate long and two short dashes line in FIG. 4C), the purge amount is appropriately prevented from being excessively increased (shown with the alternate long and two short dashes line in FIG. 4D), which is brought about by the tank vapor being excessively increased and which may cause a disturbance of the air-fuel ratio.

By gradually increasing the purge amount in this manner, a disturbance of the air-fuel ratio that is caused when the purge amount is increased is appropriately compensated for by the air-fuel ratio feedback control. A speed when the opening of the purge amount adjusting valve 71*a* is increased is previously set to a range capable of compensating for the disturbance of the air-fuel ratio by the air-fuel ratio feedback control.

On the other hand, in step S230, if the ECU 50 judges that the open valve flag XTNKOPN is not set to ON, i.e., the tank internal pressure control valve 60 is closed, this procedure is once completed. In such a case, the opening of the purge amount adjusting valve 71a is set to an opening corresponding to the target purge ratio.

The following features can be realized by using the above described embodiment. When the tank internal pressure control valve 60 is opened, the opening of the purge amount adjusting valve 71*a* is decreased so that the urge amount is controlled to be smaller than an amount corresponding to the target purge ratio. Therefore, even if the vapor amount and concentration of the vapor in the canister 40 are temporarily increased as the tank internal pressure control valve 60 is opened, disturbance thereby of the air-fuel ratio is prevented, and it is possible to suppress the deterioration in air-fuel ratio control. Since the purge amount adjusting valve 71*a* is once fully closed, it is possible to suppress the deterioration in the air-fuel ratio control more reliably.

After the opening of the purge amount adjusting valve 71*a* is decreased as described above, the opening is gradually increased up to the opening set based on the target purge ratio. Therefore, it is possible to suppress abrupt variation in vapor amount and concentration of vapor to be purged by the intake passage 12, to suppress the deterioration in the air-fuel ratio control, and to ensure a predetermined purge amount corresponding to the target purge amount.

Further, since the open and closed state of the tank internal pressure control valve 60 can be judged based on the internal pressure Pt of the fuel tank 30 detected by the pressure sensor 32, it is possible to easily and reliably judge the valve-opening timing of the tank internal pressure control valve 60, to precisely grasp the timing for introducing the vapor into the canister 40 from the fuel tank 30, and to appropriately suppress deterioration in the air-fuel ratio control.

Figure 2:
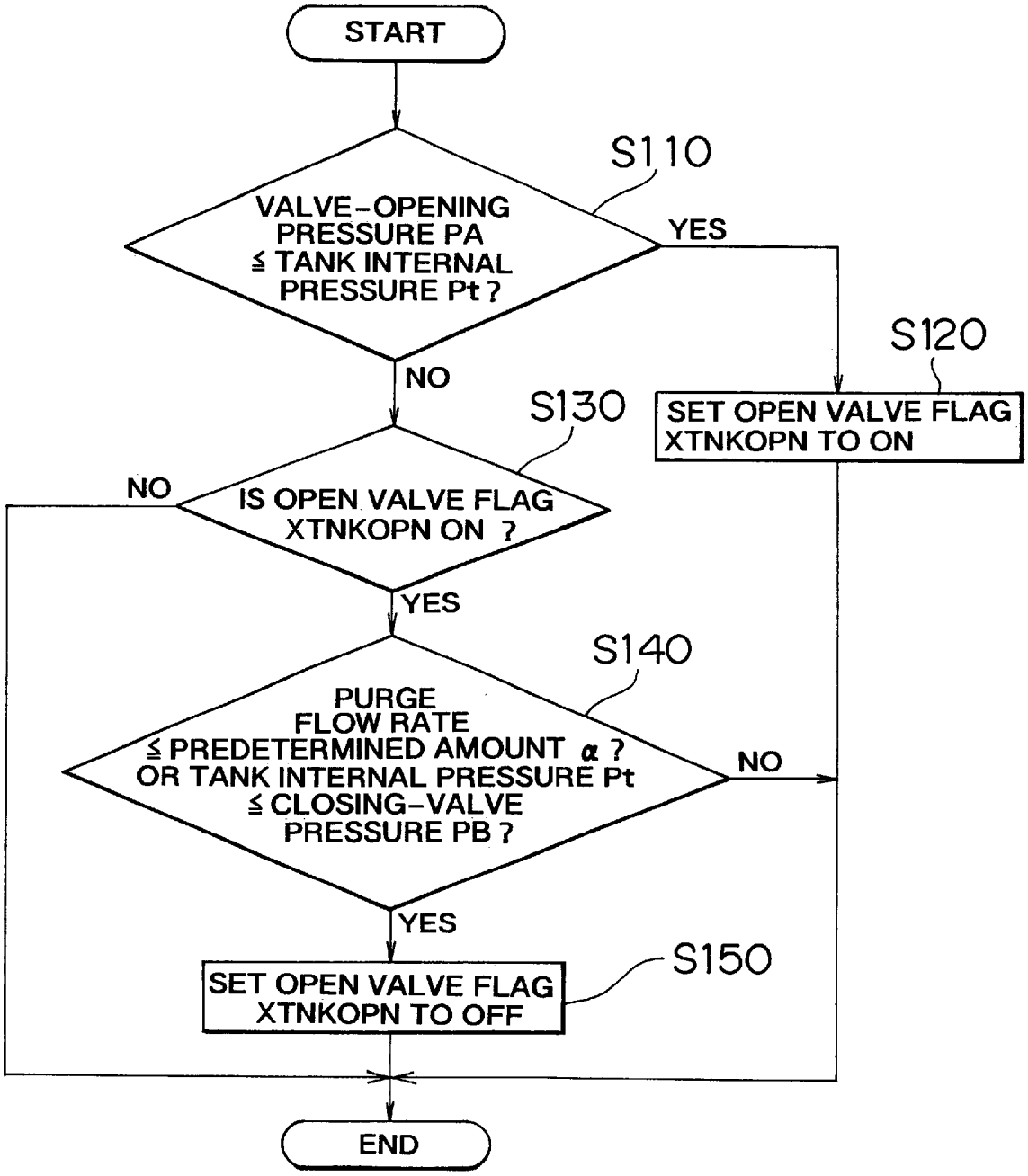
FIG. 2 is a flowchart showing a control procedure when an open and closed state of a tank internal pressure control valve is judged in the embodiment.

In a modification to the above-described embodiment, in step S140 shown in FIG. 2, the ECU 50 judges that the tank internal pressure control valve 60 is closed based logical OR whether or not the purge amount becomes equal or smaller than the predetermined amount $\alpha$ or whether or not the tank internal pressure Pt becomes equal to or smaller than the predetermined closing-valve pressure PB, but the invention is not limited to this embodiment. The control valve 60 may be judged as being closed only when the purge amount becomes equal to or smaller than the predetermined amount $\alpha$ or only when the tank internal pressure Pt becomes equal to or smaller than the predetermined closing-valve pressure PB.

In the above embodiment, the open and closed state of the tank internal pressure control valve 60 is detected based on the internal pressure Pt of the fuel tank 30, and based on this detection result, the purge amount adjusting valve 71*a* is controlled. Alternatively for example, the tank internal pressure control valve 60 may be provided with a sensor for directly detecting the open and closed state of the tank internal pressure control valve 60, and based on this detection result, the purge amount adjusting valve 71*a* may be controlled.

A solenoid valve or the like which is opened and closed by the ECU 50 may be used as the tank internal pressure control valve. In this case, when the internal pressure of the fuel tank 30 detected by the pressure sensor 32, for example, rises up to a predetermined pressure, the tank internal pressure control valve 60 is opened, and as this valve is opened the opening of the purge amount adjusting valve 71*a* may be controlled.

In this embodiment, when the tank internal pressure control valve 60 is opened, the opening of the purge amount adjusting valve 71*a* is opened as described above, but the invention is not limited to this embodiment. For example, the breather valve 33 usually opens when fuel is supplied, but the breather valve 33 opens with vibration of the vehicle in some cases. Thereupon, the fact that the breather valve 33 has opened may be detected, and when the valve 33 is opened, the purge amount adjusting valve 71*a* may be opened. Further, when both the valves 33 and 60 are opened, the purge amount adjusting valve 71*a* may be opened.

In the embodiment, when the tank internal pressure control valve 60 is opened, the purge amount adjusting valve 71*a* is once fully closed (0) and then, the tank internal pressure control valve 60 is gradually opened with a predetermined speed up to an opening corresponding to the target purge ratio, but the control of the opening of the purge passage 71 is not limited to this. For example, the opening of the purge amount adjusting valve 71*a* may be decreased to an opening other than "0". Alternatively, after the opening of the purge amount adjusting valve 71*a* is decreased to a predetermined opening (including "0" or other than "0"), this state may be maintained for a predetermine time and then, the purge amount adjusting valve 71*a* may be gradually opened. Alternatively, a speed for gradually opening the purge amount adjusting valve 71*a* may be changed in accordance with the tank internal pressure Pt, for example. At that time, the opening speed of the purge amount adjusting valve 71*a* is set to become slower the higher the internal pressure Pt.

In short, when the tank internal pressure control valve is opened as the fuel tank internal pressure rises, the opening of the purge amount adjusting valve is set to less than the target opening based on the operating state of the engine.

In the illustrated embodiment, the controller (ECU 50) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller also can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. On the contrary, the invention is intended to cover various modifications and equivalent arrangements. In addition, while the various elements of the invention are shown in various combinations and configurations which are exemplary, other combinations and configurations, including more, less or only a single element, are also within the spirit and scope of the invention.

What is claimed is:

1. An evaporative fuel control apparatus for an internal combustion engine, comprising:

a canister that collects evaporated fuel generated in a fuel tank;

an introducing valve in a communication passage between the canister and the fuel tank, which introduces the evaporated fuel in the fuel tank into the canister;

a purge amount adjusting valve in a purge passage between the canister and an intake passage of the internal combustion engine, which adjusts an amount of purge to be purged from the canister to the intake passage; and a controller that controls the purge amount adjusting valve based on an operating state of the engine, the controller decreasing the opening amount of the purge amount adjusting valve to less than a target opening amount, based on the operating state of the engine, when the introducing valve is opened.

2. An evaporative fuel control apparatus according to claim 1, wherein the controller initially decreases the opening amount of the purge amount adjusting valve to less than the target opening amount and then gradually increases the opening amount up to the target opening amount.

3. An evaporative fuel control apparatus according to claim 1, wherein when the controller decreases the opening amount of the purge amount adjusting valve to less than the target opening amount, the controller fully closes the purge amount adjusting valve.

4. An evaporative fuel control apparatus according to claim 3, wherein after closing the purge amount adjusting valve, the controller gradually increases the opening amount up to the target opening amount.

5. An evaporative fuel control apparatus according to claim 1, further comprising:

a pressure sensor that detects an internal pressure of the fuel tank, wherein the controller judges a valve-opening timing of the introducing valve based on the internal pressure of the fuel tank detected by the pressure sensor, and decreases the opening amount of the purge amount adjusting valve to less than the target opening amount based on the valve-opening timing.

6. A method for controlling an evaporative fuel control apparatus of an internal combustion engine, comprising:

determining whether an introducing valve, located in a communication passage between a canister and a fuel tank, which introduces evaporated fuel from the fuel tank into the canister, is open; and decreasing an opening amount of a purge amount adjusting valve, located in a purge passage between the canister and an intake passage of the internal combustion engine, which adjusts an amount of purge to be purged from the canister to the intake passage, to less than a target opening amount based on an operating state of the engine when the introducing valve is opened.

7. A control method according to claim 6, further comprising gradually increasing the opening amount up to the target opening amount.

8. A control method according to claim 6, wherein the step of decreasing the opening amount of the purge amount adjusting valve to less than the target opening amount fully closes the purge amount adjusting valve.

9. A control method according to claim 8, further comprising gradually increasing the opening amount up to the target opening amount.

10. A control method according to claim 6, further comprising:

sensing an internal pressure of the fuel tank using a pressure sensor;

timing the opening of the introducing valve based on the internal pressure of the fuel tank detected by the pressure sensor; and decreasing the opening amount of the purge amount adjusting valve to less than the target opening amount based on the timing of the introducing valve.

* * * * *